United States Patent [19]

Ishikawa et al.

[11] Patent Number: 4,469,164

[45] Date of Patent: Sep. 4, 1984

[54] METHOD OF AND APPARATUS FOR INSPECTING THE QUALITY OF A CASTING PRODUCED BY A DIE-CASTING MACHINE

[75] Inventors: Soichi Ishikawa, Nagoya; Masaaki Tokui, Toyota, both of Japan

[73] Assignee: Toyota Jidosha Kogyo Kabushiki Kaisha, Aichi, Japan

[21] Appl. No.: 375,015

[22] Filed: May 5, 1982

[30] Foreign Application Priority Data

May 15, 1981 [JP] Japan ..... 56-73095

[51] Int. Cl.[3] ..... B22D 17/00

[52] U.S. Cl. ..... 164/457; 164/150

[58] Field of Search ..... 164/4.1, 457, 150, 154, 164/155, 157, 113, 312

[56] References Cited

U.S. PATENT DOCUMENTS

| | | | |
|---|---|---|---|
| 3,729,047 | 4/1973 | Bohnlein et al. | 164/457 |
| 4,213,494 | 7/1980 | Carbonnel | 164/457 |
| 4,335,778 | 6/1982 | Motomura et al. | 164/150 |

FOREIGN PATENT DOCUMENTS

| | | | |
|---|---|---|---|
| 2386859 | 12/1978 | France | 164/155 |
| 30-156663 | 12/1955 | Japan . | |
| 47-45643 | 11/1972 | Japan | 164/4.1 |
| 55-50746 | 12/1980 | Japan . | |
| 56-50768 | 5/1981 | Japan | 164/4.1 |
| 1069734 | 5/1967 | United Kingdom | 164/155 |

*Primary Examiner*—Kuang Y. Lin

*Attorney, Agent, or Firm*—Oblon, Fisher, Spivak, McClelland & Maier

[57] ABSTRACT

A method of and an apparatus for inspecting the quality a casting produced by a die-casting machine, wherein a variety of the operating conditions are monitored in each casting process and thereby the quality of the casting can be judged immediately after the casting.

9 Claims, 4 Drawing Figures

1

76
Vp>Vp1
no
yes
77
STORE COUNT t1 IN MEMORY START TIMER FOR t2
78
t1l<t1<t1u
no
yes
79
TIME t1 ERROR ERROR FLAG=1
80a
Vpl<Vp<Vpu
no
yes
81a
SPEED Vp ERROR ERROR FLAG=1
82a
Σ Vp
Np= Np+1
no
Xc>Xco
83
yes
84
STORE COUNT t2 IN MEMORY START TIMER FOR t3
85
t2l<t2<t2u
no
yes
86
TIME t2 ERROR ERROR FLAG=1
80b
Vpl<Vp<Vpu
no
yes
81b
SPEED Vp ERROR ERROR FLAG=1
82b
Σ Vp
Np= Np+1
no
Xc>Xc1
87
yes
2

METHOD OF AND APPARATUS FOR INSPECTING THE QUALITY OF A CASTING PRODUCED BY A DIE-CASTING MACHINE

BACKGROUND OF THE INVENTION

1. Field of the Invention:

The present invention relates to a method and an apparatus for inspecting castings produced by a die-casting machine for defects, such as internal defects, by monitoring operating conditions of the die-casting machine.

2. Description of the Prior Art

Aluminum die-castings produced by a die-casting machine have heretofore been inspected for casting defects, particularly internal defects, generally by means of an X-ray or ultrasonic inspection apparatus which is quite expensive and requires many inspection steps. Such an inspection process is normally carried out on a number of castings grouped as a lot subsequently to the diecasting process. Therefore, there is a tendency in such an inspection that even when defective products are produced due to improper operating conditions, such as die mold temperature, molten-metal temperature, plunger tip speed, counterplunger tip displacement, relative position and speed between the plunger and counterplunger tips, and the like, resulting from malfunctioning of the die-casting machine, such defective castings are found only in a later inspection process and a relatively long period of time is thus needed to detect defective castings with the result that many unwanted defective products continue to be produced until detection of the defect. With the time lag of detection of defective castings during production thereof, some improper operating conditions are liable to return to normal during the time lag. Thus, it is often difficult to detect the cause of such imperfect castings and hence no measure can easily be taken for reliably preventing the production of more of such defective castings.

The present invention has been made in an effort to eliminate the foregoing problems.

SUMMARY OF THE INVENTION

Therefore, it is an object of the present invention to provide a method and an apparatus for inspecting the quality of a casting produced by a die-casting machine, wherein the method and apparatus are free of the drawbacks above noted in the conventional inspection methods and apparata.

More specifically, it is the object of the present invention to provide a method and an apparatus for inspecting the quality of a casting produced by a die-casting machine, wherein the inspection is done while a casting process is being carried out, thereby reducing the production of unwanted defective castings.

It is another object of the present invention to provide a method and an apparatus for inspecting the quality of a casting produced by a die casting machine which enable the operating conditions of a casting process to be adjusted to normal when abnormal operating conditions are detected during the casting process, thereby easily adjusting the casting process to normal conditions.

It is a still another object to provide an economical method and an economical apparatus for inspecting the quality of a casting produced by a die-casting machine.

The present invention is based on the discovery that when the die-casting machine is operated while its operating conditions are maintained in specific ranges, castings of acceptable quality can be produced; and when the die-casting machine is operated while its operating conditions deviate from the specified ranges, castings of unacceptable quality are produced. According to the present invention, the method and apparatus for inspecting castings as to acceptability is characterized in that a variety of the operating conditions are monitored in each casting process, and thereby the quality of the casting can be judged immediately after the casting.

According to the present invention, there are provided a method and an apparatus for inspecting castings for acceptability by monitoring operating conditions of a die-casting machine in each casting process and determining the casting for acceptability immediately after the casting process has been completed.

The present invention resides in that castings produced by a die-casting machine having a plunger tip and a counter-plunger tip can be inspected for acceptability by measuring an interval of time required for the amount of displacement of the counter-plunger tip to reach a predetermined value after the speed of travel of the plunger tip has reached a predetermined value during die casting under pressure, and by ascertaining whether the interval of time falls within a certain range that is established for producing die-castings of accepting quality.

DESCRIPTION OF THE PREFERRED EMBODIMENTS

Figure 1:
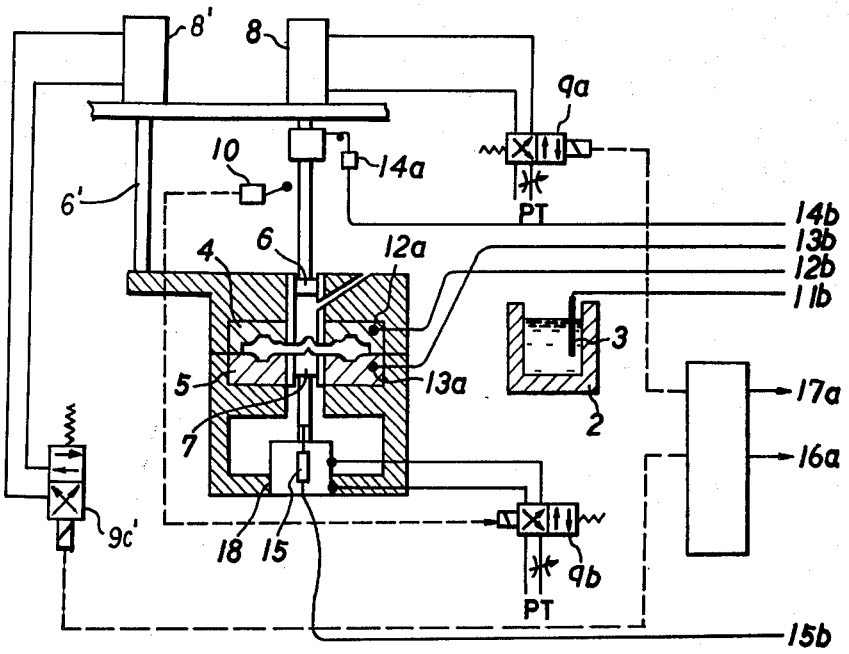
FIG. 1 is a schematic block diagram arrangement of a vertical die-casting machine.
Figure 2:
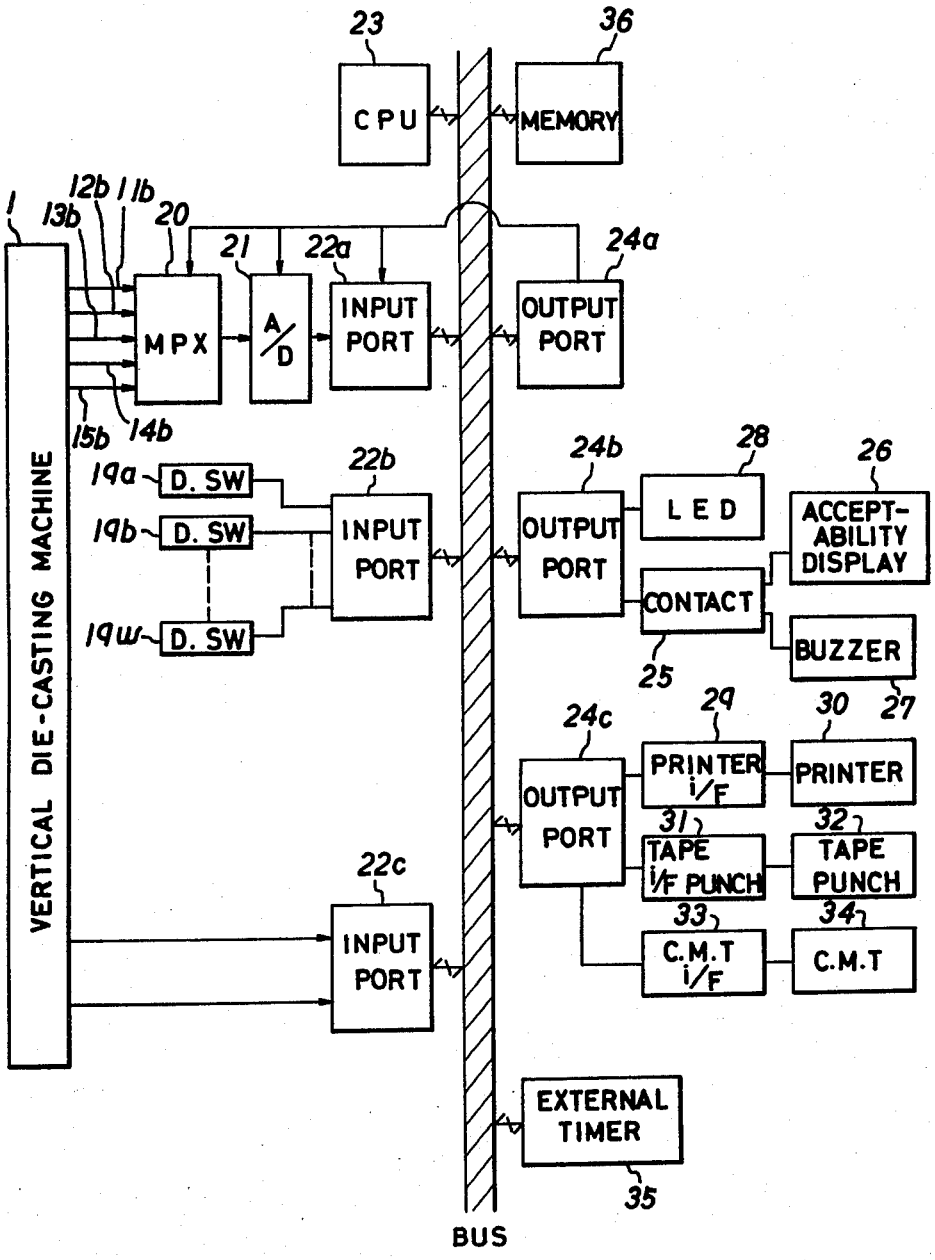
FIG. 2 is a block diagram of an embodiment according to the present invention.

Referring now to the drawings, wherein like reference numerals designate identical or corresponding parts throughout the several views, and more particularly to FIGS. 1 and 2 thereof; FIGS. 1 and 2 show a vertical die-casting machine which includes a thermocouple 3 placed in a thermally insulated furnace 2 containing molten metal to be poured into a die. The thermocouple 3 delivers a signal indicative of a temperature of the molten metal over a line 11*b*. Thermocouples 12*a*, 13*a* embedded in upper and lower die members 4, 5 deliver signals indicative of temperatures of the upper and lower die molds 4, 5 over lines 12*b*, 13*b*. A speed sensor 14*a* which is attached to a plunger tip 6 supplies a plunger speed signal over a line 14*b*. A displacement sensor 15 mounted on a counterplunger tip 7 supplies a counterplunger displacement signal over a line 15*b*. A signal indicative of die opening and closing is delivered over a line 16*a* which provides a timing signal for the starting of monitoring operations. A contact signal is delivered over a line 17*a* as a signal for starting the injection of molten metal.

Figure 3:
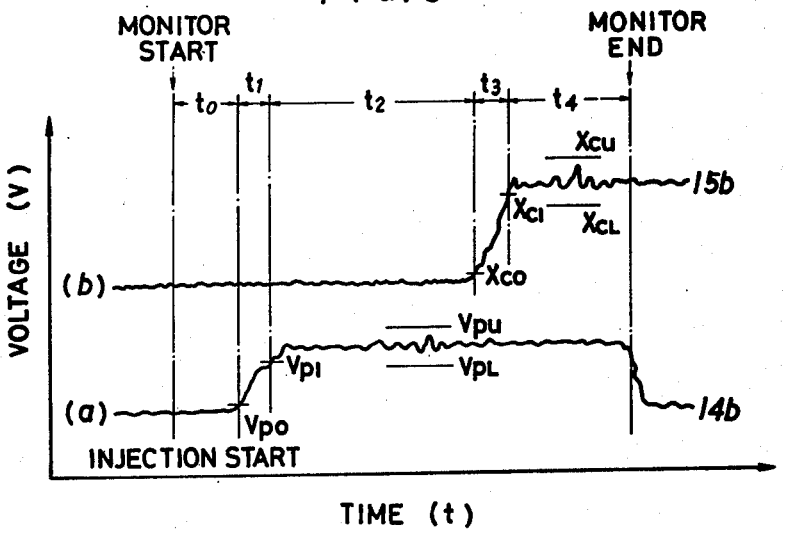
FIG. 3 is a graph showing the speed of movement of a plunger tip and the amount of displacement of a counterplunger tip.

Out of the above signals, the plunger speed signal and the counterplunger displacement signal which have a controlling effect on the quality of die-castings are shown as curves (a) and (b), respectively, in the graph of FIG. 3, these two signals being variable in time intervals $t_0$ through $t_4$.

As shown in FIG. 2, the molten-metal temperature signal, the upper mold temperature signal, and the lower mold temperature signal are supplied respectively over the lines 11b, 12b, 13b as analog signals to a multiplexer 20. The plunger speed signal and counter-plunger displacement signals are supplied over the lines 14b, 15b, respectively, as analog signals to the multiplexer 20. These signals are selected by the multiplexer 20, and digitized by an A/D converter 21. The digitized signals are read by a microprocessor through an input port 22a. The die mold opening-closing signal and the injection starting signal are supplied as contact signals respectively over the lines 16a, 17a to the microprocessor via an input port 22c. Operating conditions of a die-casting machine which are established for producing die-castings of acceptable quality, and upper and lower limits for the plunger speed signal Vp and the counter-plunger displacement signal Xc as related to timing intervals $t_0$ through $T_3$, are set by digital switches 19a through 19w, and read by the microprocessor through an input port 22b. The microprocessor or central processing unit (hereinafter referred to as "CPU") 23 are adapted to determine whether the molten-metal temperature signal, the upper mold temperature signal, the lower mold temperature signal, the plunger speed signal, and the counterplunger displacement signal as they have been read via the input port 22a fall within ranges defined by the upper and lower limits. When the signals do not fall within the ranges, a signal is delivered via an output port 24b to a contact signal output circuit 25, whch then produces a contact output signal to enable a defect display circuit 26 to energize a lamp or a buzzer 27 or to give off a buzzer sound, thereby giving an alarm to the operator. The operating conditions that have caused the defective casting are indicated on an LED display circuit 28.

To record the results of monitoring in each frame for facilitating later statistical processing, an output port 24c is connected to a printer 30 via a printer interface 29, a paper tape punch 32 via a paper tape punch interface 31, and a cassette magnetic tape (MT) 34 via a cassette MT interface 33. The printer 30, the paper tape punch 32, and the cassette MT 34 serve to record supplied information separately. An external timer 35 serves to count the timing intervals $t_0$ through $t_4$ as shown in FIG. 3.

Figure 4A:
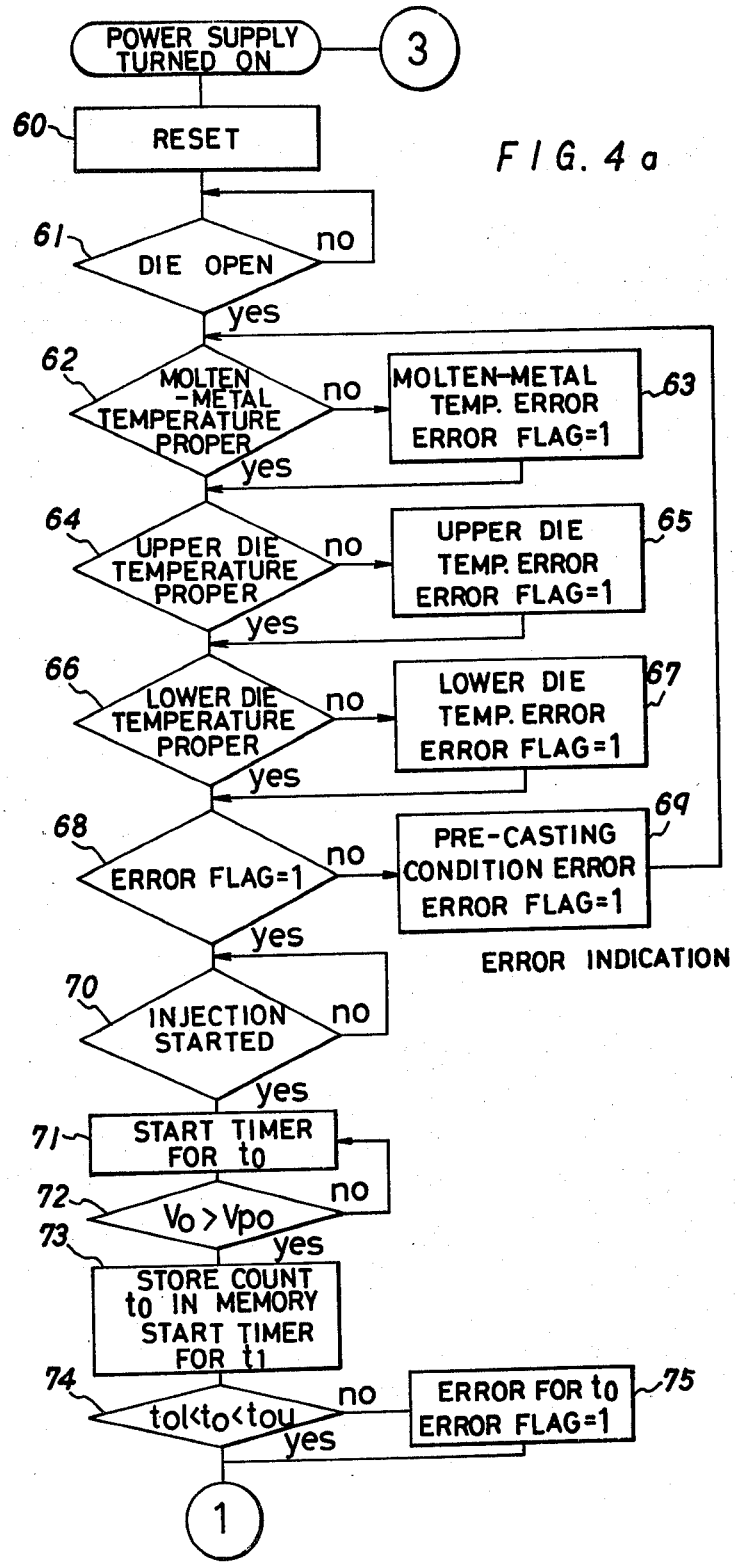
FIG. 4 is a flowchart illustrative of operations of the embodiment according to the present invention.
Figure 4B:
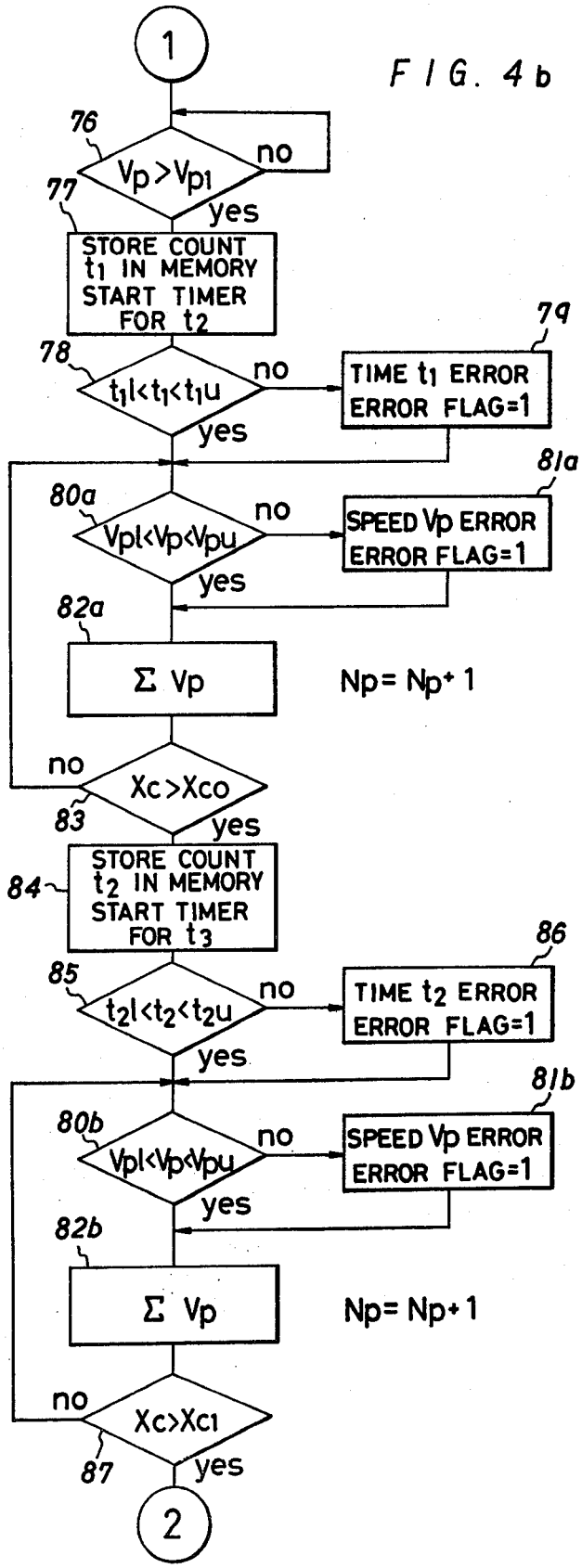
Figure 4C:
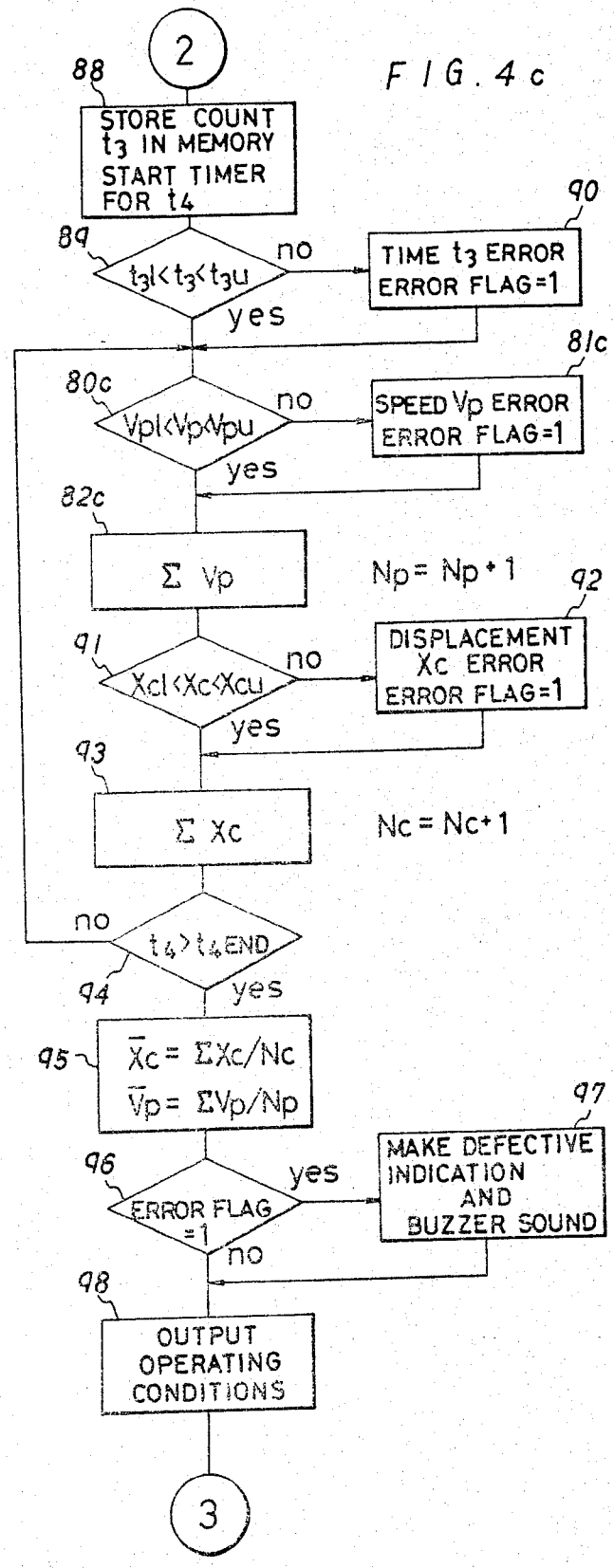

Operation of the apparatus according to the illustrated embodiment will now be described with reference to a flowchart shown in FIG. 4, which are illustrative of operations of the CPU 23 of FIG. 2.

All of the components are reset to initial conditions at a step 60. A mold closing signal is awaited at a step 61. When such a signal is generated, a directional control valve 9c for actuating a plunger cylinder 8' is opened to pressurize the plunger cylinder 8' which is connected to the upper die member 4 via a connecting rod 6' for thereby lowering the upper die member 4 and step 61 determines whether the die is closed on the basis of the mold opening-closing signal delivered over the line 16a. The input is repeatedly supplied at the step 61 until the die is closed. When a die closing signal is supplied, the program then goes to a step 62.

In the step 62, the temperature of molten metal in the thermally insulated furnace 2 is read as a molten-metal temperature signal into the CPU 23 through the multiplexer 20 and the A/D converter 21, and the read signal is compared with the upper and lower molten-metal temperature limits which have been set by the digital switches 19a, 19b for producing castings of acceptable quality. If the signal is within a range defined by such upper and lower limits, then the program proceeds to a step 64. If the signal does not fall within the range, then a molten-metal temperature error is displayed and an error flag (hereinafter referred to as an "error flag=1") is generated at a step 63, and the program goes to the step 64.

The temperature of the upper mold is read as an upper mold temperature signal via the line 12b at the step 64 as with the molten-metal temperature. The signal thus read is compared with the upper and lower limits set by the digital switches 19c, 19d for the temperature of the upper mold. If the signal falls within the allowable range determined by such upper and lower limits, then the program goes to a step 66. If, on the other hand, the signal falls outside the range, then an upper mold temperature error is displayed and an error flag=1 is produced, and thereafter the program proceeds to the step 66.

The step 66 and step 67 serve to determine whether the temperature of the lower mold is within a set range in the manner as described above for the temperature of the upper mold. After the determination, the program advances to a step 68.

In the step 68, the program determines whether one or more of the molten-metal temperature, the upper mold temperature, and the lower mold temperature are out of the established ranges by ascertaining if there is an error flag in each of the steps 63, 65, 67. If there is an error flag=1, a command is generated to prevent pouring and injection of molten metal as casting conditions are not met, and at the same time the error flag in each of the steps 63, 65, 67 is reset to an error flag=0. The program goes back to the step 62, and repeatedly follows the steps 62 through 68 until the step 68 has an error flag=0. When the error flag=0 is established in the step 68, it is determined that the casting conditions are met, and the program goes to a step 70.

An injection starting signal is awaited at the step 70. When such a signal is generated, a directional control valve 9a for actuating a plunger cylinder 8 is opened to pressurize the plunger cylinder 8 for thereby lowering the plunger tip 6 in FIG. 1. The speed Vp of travel of the plunger 6 is measured by the speed sensor 14a. The speed sensor 14a produces an output as shown by the curve (a) in FIG. 3 during one cycle of die-casting process.

The interval of time $t_0$ which is required for the plunger 6 to start after the injection has started and the plunger cylinder 8 has been pressurized, is measured by starting the timer 35 at a step 71, comparing the plunger speed Vp with a speed $Vp_0$ that has been set by the digital switch 19g and is indicative of starting of the plunger tip 6 at a step 73, proceeding to a step 73 when the speed Vp exceeds the speed $Vp_0$, and storing the count of the time interval $t_0$ by the timer 35 into a memory 36. And after the lapse of time to the plunger 6 begins to move downward in FIG. 1 and will reach to the specified velocity $Vp_1$. Meanwhile, the timer 35 is set to start for the purpose of measuring the rise time $t_1$ in which the specified velocity $Vp_1$ is attained. Then, the program goes to a step 74.

The step 74 compares the measured time $t_0$ with an upper limit $t_{0U}$ and lower limit $t_{0L}$ for the time $t_0$ that have been set by the digital switches 19h, 19i for normal operation. If the measured time $t_0$ is in a range defined by the upper and lower limits, then the program goes to a step 76. If the measured time $t_0$ is outside the range, an error for the time $t_0$ is indicated and an error flag=1 is generated. Then, the program proceeds to a step 76.

In the step 76, the plunger speed Vp is compared with a speed $Vp_1$ which has been set by the digital switch 19*j* and is indicative of completion of the rise time $t_1$. The speed Vp is continuously sampled until the speed Vp exceeds the speed $Vp_1$. When the speed Vp exceeds the speed $Vp_1$, the count in the timer 35 is stored as the rise time $t_1$ for the plunger tip 6 into the memory 36 at a step 77. Simultaneously, the timer 35 starts counting the time interval $t_2$. The program then advances to a step 78.

The step 78 compares the rise time $t_1$ for the plunger tip 6 which has been measured before with an upper limit $t_{1U}$ and a lower limit $t_{1L}$ for the rise time $t_1$ that have been set by the digital switches 19K, 19L for normal operation. If the rise time $t_1$ falls within a range between the upper and lower limits, then the program goes to a step 80*a*. If not, then an error for the time $t_1$ is indicated and an error flag=1 is produced. The program then progresses to a step 80*a*.

In the step 80*a*, the plunger speed Vp is compared with an upper limit $V_{PU}$ and a lower limit $V_{PL}$ which have been set by the digital switches 19*m*, 19*n* for the plunger speed Vp to be kept therebetween during normal operation. If the speed Vp falls within a range between the upper and lower limits, then the program proceeds to a step 82*a*. If not, the program goes to a step 81*a* in which an error for the speed Vp is indicated and an error flag=1 is established. Thereafter, the program goes to a step 82*a*.

Sampled values for the speed Vp that have been obtained so far are accumulated, and the number of accumulations $Np=Np+1$ up to this point is obtained at the step 82*a* to find the mean speed Vp at a later time.

In a step 83, the output Xc (indicated by the curve (b) in FIG. 3) generated by the displacement sensor 15 as indicating the amount of displacement of the counterplunger tip 7 is compared with a value $Xc_0$ of displacement which has been set by the digital switch 19O and indicates starting of displacement of the counterplunger tip 7. If the value Xc does not exceed the value $Xc_0$, then the program goes back to the step 80*a*, and the comparison is repeated until Xc goes beyond $Xc_0$. When the value Xc exceeds the value $Xc_0$, the program proceeds to a step 84.

The count for the time interval $t_2$ which has been started at the step 77 is stored into the memory 36 at the step 84. At the same time until the amount of the displacement of the counter tip will attain to the specified value $X_{c1}$, the rise time $t_3$ starts being counted. Then, the program goes to a step 85.

In the step 85, the time interval $t_2$ that has been counted before is compared with an upper limit $t_{2U}$ and lower limit $t_{2L}$ which have previously been set by the digital switches 19P, 19Q for the time interval $t_2$ to be maintained therebetween during normal operation of the die-casting machine. If the time interval $t_2$ falls within a range between the upper and lower limits, then the program goes to a step 80*b*. If not, then the program goes to a step 86 in which an error for the time $t_2$ is indicated and an error flag=1 is generated. Then, the program goes to a step 80*b*.

The time interval $t_2$ thus measured, which is required for the amount of displacement of the counterplunger tip 7 to reach the value $Xc_0$ after the speed of travel of the plunger tip 6 has reached the value $Vp_1$, has a large effect on the quality of dis-castings produced by the die-casting machine 1. According to the prevent invention, the quality of such die-castings is determined as acceptable when the time interval $t_2$ is within the range between the upper and lower limits $t_{2U}$, $t_{2L}$. When the time interval $t_2$ is not within the range, the die-castings produced are determined as unacceptable.

The same operations as those in the steps 80*a*, 81*a*, 82*a* are effected in the steps 80*b*, 81*b*, 82*b*. Thereafter, the program proceeds to a step 87.

The step 87 compares the output Xc indicative of the amount of displacement of the counterplunger tip 7 with a value $Xc_1$ which has been set in advance by the digital switch 19*r* and is in the vicinity of the maximum displacement of the counter-plunger tip 7. If the value Xc does not exceed the value $Xc_1$, then the program goes back to the step 80*b* to repeat the comparison. If the value Xc exceeds the value $Xc_1$, then the program goes to a step 88.

In the step 88, the count of the rise time $t_3$ of operation of the counter-plunger tip 7 which has started at the step 84 is stored into the memory 36, and at the same time counting of the time interval $t_4$ in which the monitoring operation is finished is started. Then, the program goes to a step 89.

The step 89 compares the rise time $t_3$ for the counterplunger tip which has been counted with upper and lower limits $t_{3U}$, $t_{3L}$ which have been set in advance by the digital switches 19*s*, 19*t* for the rise time $t_3$ for normal operation. If the rise time $t_3$ is within a range between the upper and lower limits, then the program goes to a step 80*c*. If not, the program goes to a step 90 in which an error for the rise time $t_3$ is indicated and an error flag=1 is produced. Thereafter, the program proceeds to the step 80*c*.

The same operations as those in the steps 80*a*, 81*a*, 82*a* are carried out in the steps 80*c*, 81*c*, 82*c*. Thereafter, the program goes to a step 91.

In the step 91, the output XC that is indicative of the amount of displacement of the counterplunger tip 7 is compared with upper and lower limits $X_{CU}$, $X_{CL}$ which have previously been set by the digital switches 19U, 19V. If the value Xc is between the upper and lower limits, then the program goes to a step 93. If not, the program proceeds to a step 92 in which an error for the value Xc is indicated and an error flag=1 is generated. Thereafter, the program goes to a step 93.

Samples values for the displacement output Xc which have been measured so far are accumulated, and the number of accumulations $Nc=Nc+1$ is obtained at the step 93 to find the mean displacement output Xc at a later time.

A step 94 compares the monitoring completion time interval $t_4$ which has previously been counted by the timer with a value $t_{4end}$ which has been set by the digital switch 19*w* as the maximum time interval required for the monitoring to end during normal operation. If the time interval $t_4$ does not exceed the value $t_{4end}$, then the program goes back to the step 80*c* to repeat the operations up to the step 94. If the time interval $t_4$ exceeds the value $t_{4end}$, the monitoring is determined as being finished, and the program goes to a step 95, which determines the mean value $\overline{Xc}$ ($=\Sigma$ Xc/Nc) of the displacement output Xc and the mean value $\overline{Vp}$ ($=\Sigma$ Vp/Np) of the plunger speed Vp. Then, the program proceeds to a step 96.

The step 96 determines whether at least one of the operating conditions as measured above does not fall within its allowable range by ascertaining if the error flag is 1. If the error flag=0, then the program goes to a step 98. If the error flag=1, then the program goes to a step 97 to enable the defect display 26 to indicate a defective die-casting and also the buzzer 27 to produce a buzzer sound, thereby giving the operator an alarm. The program then goes to a step 98.

In the step 98, the monitored operating conditions of the die-casting machine, such as molten-metal temperature, mold temperature, plunger speed, counter-plunger displacement, timing, and other conditions, are delivered via the output port 24*c* so as to be recorded by the printer 30, the paper card punch 32, and the cassette MT 34. One cycle of monitoring operations is thus completed.

With the foregoing arrangement and operation of the present invention, an expensive X-ray inspection apparatus and expensive inspection processes can be eliminated which have heretofore been employed in quality inspection. Since the quality of a die-casting can be determined for acceptability right after it has been produced, unnecessary defective die-castings are not produced which would otherwise be produced until they would be found in a later inspection process.

With the operating conditions of the die-casting machine being monitored according to the illustrated embodiment, an alarm can be given immediately when a defective die-casting is produced, and operating conditions which have caused such a defective die-casting are stored and displayed, an arrangement which allows countermeasures to be easily taken against production of defective products. The illustrated embodiment can be used not only for inspecting products for acceptability, but as an apparatus for diagnosing failures of a die-casting machine.

Thus, expensive inspection apparatus and processes as required by X-ray inspection equipment can be dispensed with, and unwanted defective castings can be eliminated which would otherwise be produced in quantities before they would be found in a later inspection process.

While the invention has been particularly shown and described with reference to preferred embodiments thereof, it will be understood by those skilled in the art that the foregoing and other changes in form and details can be made therein without departing from the spirit and scope of the invention.

What is claimed as new and desired to be secured by Letters Patent of the United States is:

1. A method of inspecting the quality of a casting produced by a die-casting machine having a plunger tip and a counterplunger tip, comprising the steps of measuring the speed of movement of said plunger tip and the amount of displacement of said counterplunger tip upon die casting under pressure, measuring an interval of time required for the amount of displacement of said counterplunger tip to reach a predetermined value after the speed of movement of said plunger tip has reached a predetermined value, and ascertaining whether said interval of time falls within a predetermined range to determine the quality of the casing for acceptability.

2. An apparatus for inspecting the quality of a casting produced by a die-casting machine having a plunger tip and a counterplunger tip, comprising a speedometer for measuring the speed of movement of said plunger tip, a displacement meter for measuring the amount of displacement of said counterplunger tip, a timer for measuring an interval of time required for the measured value on said displacement meter to reach a predetermined value after the measured value on said speedometer has reached a predetermined value, a decision circuit for determining whether the measured value on said timer falls within a predetermined range, and a display unit for displaying a decision by said decision circuit when such a decision is in the negative.

3. The apparatus claimed in claim 2, wherein the display unit is a printer for recording and displaying the monitored outputs.

4. The apparatus claimed in claim 2, further comprising a punch for recording the monitored outputs.

5. The apparatus claimed in claim 2, further comprising a cassette for recording the monitored outputs.

6. The apparatus claimed in claim 2, further comprising an alarm generator for generating an alarm when an unacceptable casting is produced.

7. The apparatus claimed in claim 2, wherein the display unit is a lamp.

8. The apparatus claimed in claim 7, wherein comprising means for making an indication that an unacceptable casting is produced when at least one of the monitored outputs is outside of the range between the upper and lower limits set as acceptable for the production of an acceptable casting.

9. The apparatus claimed in claim 4 or 5 which is connected to CPU.

* * * * *